US011315482B2

(12) United States Patent
Cho et al.

(10) Patent No.: US 11,315,482 B2
(45) Date of Patent: Apr. 26, 2022

(54) PIXEL AND DISPLAY DEVICE HAVING THE SAME

(71) Applicant: SAMSUNG DISPLAY CO., LTD., Yongin-si (KR)

(72) Inventors: Dae Youn Cho, Yongin-si (KR); Ji Ho Moon, Yongin-si (KR); Jong Woo Park, Yongin-si (KR); Young Tae Choi, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/813,982

(22) Filed: Mar. 10, 2020

(65) Prior Publication Data

US 2020/0327850 A1 Oct. 15, 2020

(30) Foreign Application Priority Data

Apr. 15, 2019 (KR) ..... 10-2019-0043914

(51) Int. Cl.
*G09G 3/30* (2006.01)
*G09G 3/32* (2016.01)

(52) U.S. Cl.
CPC ..... *G09G 3/32* (2013.01); *G09G 2300/0876* (2013.01); *G09G 2310/062* (2013.01); *G09G 2330/028* (2013.01)

(58) Field of Classification Search
CPC ..... G09G 3/30–3291; G09G 3/32; G09G 2300/0876; G09G 2310/062; G09G 2330/028
See application file for complete search history.

(56) References Cited

U.S. PATENT DOCUMENTS 8,334,825 B2 * 12/2012 Kim ..... G09G 3/3233 345/82
9,390,648 B2 7/2016 Lee et al.
9,881,547 B2 1/2018 Eom
10,062,363 B2 8/2018 Kang et al.
2013/0321375 A1 * 12/2013 Ka ..... G09G 3/3233 345/212

(Continued)

FOREIGN PATENT DOCUMENTS

KR 10-2014-0028921 3/2014
KR 10-2018-0063425 6/2018

(Continued)

*Primary Examiner* — Roy P Rabindranath
(74) *Attorney, Agent, or Firm* — F. Chau & Associates, LLC

(57) ABSTRACT

A pixel includes a light emitting device, a first transistor for controlling an amount of current flowing from a first power source to a second power source via the light emitting device, in response to a voltage applied to a first node, a second transistor coupled between a data line and a second node corresponding to a first electrode of the first transistor, and including a gate electrode coupled to a first scan line, a third transistor coupled between the first node and a third node corresponding to a second electrode of the first transistor, and including a gate electrode coupled to the first scan line, and a fourth transistor coupled between the third transistor and the third node, and configured to maintain a turn-on state.

17 Claims, 6 Drawing Sheets

(56) References Cited

U.S. PATENT DOCUMENTS

| | | | | |
|---|---|---|---|---|
| 2014/0062982 | A1* | 3/2014 | Lee | G09G 3/3208 345/211 |
| 2017/0365647 | A1* | 12/2017 | Choi | G09G 3/3233 |
| 2018/0158407 | A1 | 6/2018 | Chai et al. | |
| 2018/0226023 | A1 | 8/2018 | Park et al. | |
| 2019/0164498 | A1* | 5/2019 | Jang | G09G 3/3266 |
| 2019/0213958 | A1 | 7/2019 | Cho et al. | |

FOREIGN PATENT DOCUMENTS

| | | |
|---|---|---|
| KR | 10-2018-0091985 | 8/2018 |
| KR | 10-2019-0085576 | 7/2019 |

* cited by examiner

PIXEL AND DISPLAY DEVICE HAVING THE SAME

CROSS-REFERENCE TO RELATED APPLICATION

This application claims priority under 35 U.S.C. § 119 to Korean Patent Application No. 10-2019-0043914, filed on Apr. 15, 2019 in the Korean Intellectual Property Office, the disclosure of which is incorporated by reference herein in its entirety.

TECHNICAL FIELD

Exemplary embodiments of the inventive concept generally relate to a display device, and more particularly, to a pixel and a display device having the same.

DISCUSSION OF RELATED ART

A display device displays an image by using pixels emitting lights of various colors (e.g., red, green, and blue).

The display device includes pixels coupled to data lines and scan lines. Each of the pixels generally includes a light emitting device and a driving transistor for controlling an amount of current flowing through the light emitting device. The driving transistor controls the amount of current flowing from a first power source to a second power source via the light emitting device, in accordance to a data signal. The light emitting device generates light with a predetermined luminance corresponding to the amount of current flowing from the driving transistor.

SUMMARY

According to an exemplary embodiment of the inventive concept, a pixel includes a light emitting device, a first transistor configured to control an amount of current flowing from a first power source to a second power source via the light emitting device, in response to a voltage applied to a first node, a second transistor coupled between a data line and a second node corresponding to a first electrode of the first transistor, and including a gate electrode coupled to a first scan line, a third transistor coupled between the first node and a third node corresponding to a second electrode of the first transistor, and including a gate electrode coupled to the first scan line, and a fourth transistor coupled between the third transistor and the third node, and configured to maintain a turn-on state.

The third and fourth transistors may be coupled in series between the first node and the third node.

The fourth transistor may include a gate electrode coupled to a DC power source that allows the fourth transistor to be turned on.

The gate electrode of the fourth transistor may be coupled to the second power source.

The third transistor may include a plurality of third transistors coupled in series to each other between the first node and the fourth transistor. Gate electrodes of the plurality of third transistors may be commonly coupled to the first scan line.

The pixel may further include a fifth transistor coupled between the first power source and the second node, and including a gate electrode coupled to an emission control line, a sixth transistor coupled between the third node and the light emitting device, and including a gate electrode coupled to the emission control line, and a storage capacitor coupled between the first power source and the first node.

The pixel may further include a seventh transistor coupled between the first node and an initialization power source, and including a gate electrode coupled to a second scan line, and an eighth transistor coupled between the light emitting device and the initialization power source, and including a gate electrode coupled to a third scan line.

The fourth transistor may include a gate electrode coupled to the initialization power source.

The second scan line and the third scan line may be the same scan line.

According to an exemplary embodiment of the inventive concept, a display device includes pixels coupled to scan lines, emission control lines, and data lines, a scan driver configured to supply a scan signal to the pixels through the scan lines, an emission driver configured to supply an emission control signal to the pixels through the emission control lines, and a data driver configured to supply a data signal to the pixels through the data lines. A pixel on an ith row and a jth column (where i and j are natural numbers) among the pixels includes a light emitting device, a first transistor configured to control an amount of current flowing from a first power source to a second power source via the light emitting device, in response to a voltage applied to a first node, a second transistor coupled between a jth data line and a second node corresponding to a first electrode of the first transistor, and including a gate electrode coupled to a first scan line on an ith pixel row, a third transistor coupled between the first node and a third node corresponding to a second electrode of the first transistor, and including a gate electrode coupled to the first scan line on the ith pixel row, and a fourth transistor coupled between the third transistor and the third node and configured to maintain a turn-on state.

The third and fourth transistors may be coupled in series between the first node and the third node.

The fourth transistor may include a gate electrode coupled to a DC power source that allows the fourth transistor to be turned on.

The gate electrode of the fourth transistor may be coupled to the second power source.

The third transistor may include a plurality of third transistors coupled in series to each other between the first node and the fourth transistor. Gate electrodes of the plurality of third transistors may be commonly coupled to the first scan line on the ith pixel row.

The pixel on the ith row and the jth column further may include a fifth transistor coupled between the first power source and the second node, and including a gate electrode coupled to an emission control line, a sixth transistor coupled between the third node and the light emitting device, and including a gate electrode coupled to the emission control line, and a storage capacitor coupled between the first power source and the first node.

The pixel on the ith row and the jth column further may include a seventh transistor coupled between the first node and an initialization power source, and including a gate electrode coupled to a second scan line on the ith pixel row, and an eighth transistor coupled between the light emitting device and the initialization power source, and including a gate electrode coupled to a third scan line on the ith pixel row.

The fourth transistor may include a gate electrode coupled to the initialization power source.

The display device may further include a power supply configured to generate the first power source and the second power source to supply the first power source and the second power source to the pixels, and generate third and fourth power sources to supply the third and fourth power sources to the scan driver for generating the scan signal.

The fourth transistor may include a gate electrode coupled to the low power source.

According to an exemplary embodiment of the inventive concept, a pixel includes a light emitting device, a first transistor configured to control an amount of current flowing from a first power source to a second power source via the light emitting device, in response to a voltage applied to a first node, a second transistor coupled between a data line and a second node corresponding to a first electrode of the first transistor, and including a gate electrode coupled to a scan line, a plurality of third transistors coupled in series between the first node and a fourth node, and including gate electrodes coupled to the scan line, and a fourth transistor coupled between the fourth node and a third node corresponding to a second electrode of the first transistor, and including a gate electrode coupled to a power source.

BRIEF DESCRIPTION OF THE DRAWINGS

The above and other features of the inventive concept will be become more apparent by describing in detail exemplary embodiments thereof with reference to the accompanying drawings.

DETAILED DESCRIPTION OF THE EMBODIMENTS

Figure 1:
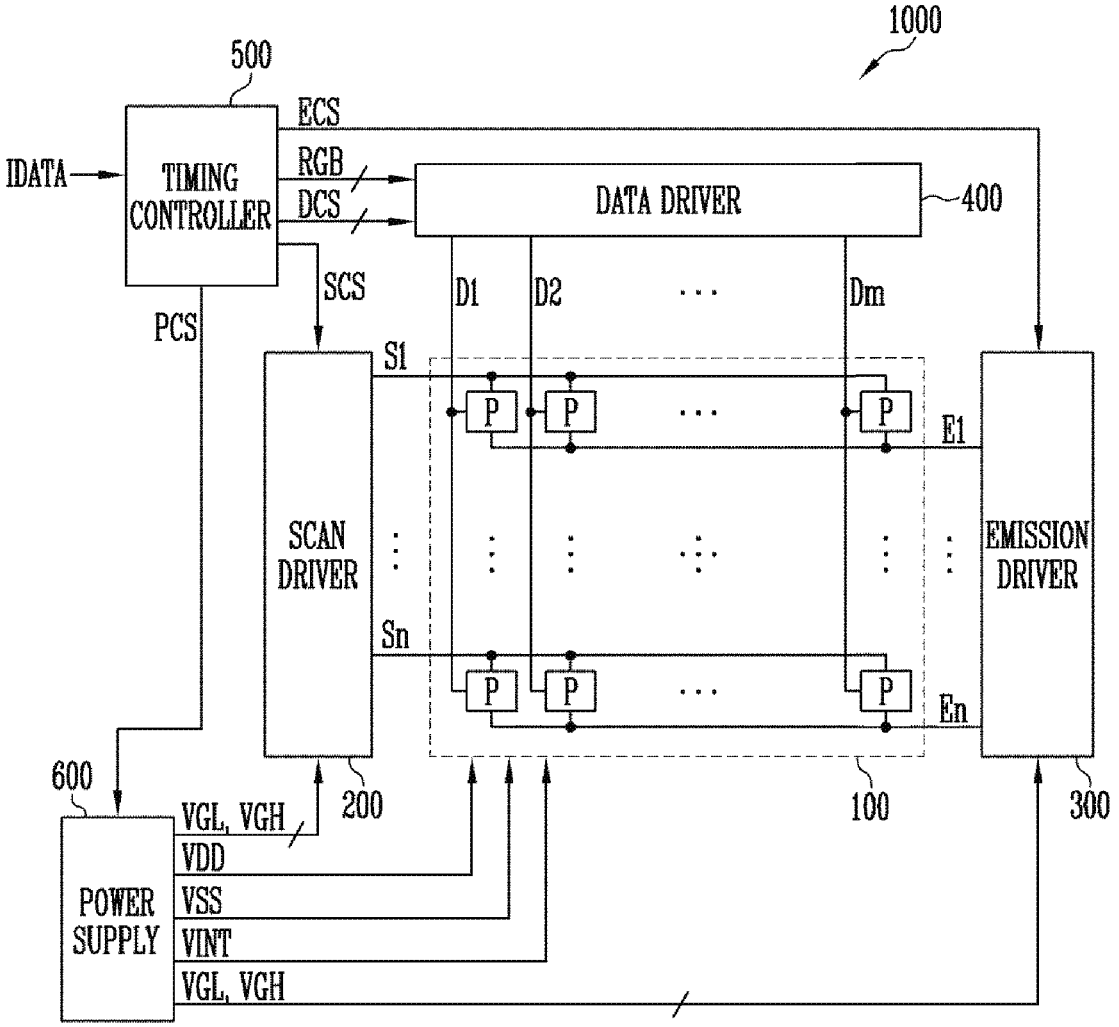
FIG. 1 is a block diagram illustrating a display device in accordance with an exemplary embodiment of the inventive concept.

Exemplary embodiments of the inventive concept provide a pixel for reducing degradation deviation of a transistor that compensates for a threshold voltage.

Exemplary embodiments of the inventive concept also provide a display device including the pixel.

Exemplary embodiments will be described more fully hereinafter with reference to the accompanying drawings. Like reference numerals may refer to like elements throughout this application.

In the specification, when an element is referred to as being "connected" or "coupled" to another element, it can be directly connected or coupled to the another element or be indirectly connected or coupled to the another element with one or more intervening elements interposed therebetween. In the drawings, dimensions may be exaggerated for clarity of illustration. It will be understood that when an element is referred to as being "between" two elements, it can be the only element between the two elements, or one or more intervening elements may also be present.

FIG. 1 is a block diagram illustrating a display device in accordance with an exemplary embodiment of the inventive concept.

Referring to FIG. 1, a display device 1000 may include a pixel unit 100, a scan driver 200, an emission driver 300, a data driver 400, and a timing controller 500.

In an exemplary embodiment of the inventive concept, the display device 1000 may further include a power supply 600 configured to supply a voltage of a first power source VDD, a voltage of a second power source VSS, and a voltage of an initialization power source VINT to the pixel unit 100.

The power supply 600 may also supply a low power source VGL and a high power source VGH, which determine a voltage level of a scan signal and/or an emission control signal, to the scan driver 200 and/or the emission driver 300. The low power source VGL and the high power source VGH may also be referred to as a third power source and a fourth power source, respectively. The low power source VGL may have a voltage level lower than that of the high power source VGH.

However, this is merely illustrative, and at least one of the first power source VDD, the second power source VSS, the initialization power source VINT, the low power source VGL, and the high power source VGH may be supplied to the timing controller 500 or the data driver 400. In addition, each of the first power source VDD, the second power source VSS, the initialization power source VINT, the low power source VGL, and the high power source VGH may be a DC power source.

In an exemplary embodiment of the inventive concept, the first power source VDD and the second power source VSS may generate voltages for driving of a light emitting device LED. In an exemplary embodiment of the inventive concept, the voltage of the second power source VSS may be lower than that of the first power source VDD. For example, the voltage of the first power source VDD may be a positive voltage, and the voltage of the second power source VSS may be a negative voltage.

The voltage of the initialization power source VINT may be set to a voltage lower than a lowest voltage of a data voltage, which will be described further below. The low power source VGL may correspond to a voltage at which transistors included in the scan driver 200 and the emission driver 300 are turned on, and the high power source VGH may correspond to a voltage at which transistors included in the scan driver 200 and the emission driver 300 are turned off.

The pixel unit 100 may include a plurality of scan lines S1 to Sn, a plurality of emission control lines E1 to En, a plurality of data lines D1 to Dm, and a plurality of pixels P respectively coupled to the scan lines S1 to Sn, the emission control lines E1 to En, and the data lines D1 to Dm (where m and n are integers greater than 1). Each of the pixels P may include a driving transistor and a plurality of switching transistors.

The timing controller 500 may generate a first control signal SCS, a second control signal ECS, and a third control signal DCS, corresponding to synchronization signals supplied from the outside. The first control signal SCS may be supplied to the scan driver 200, the second control signal ECS may be supplied to the emission driver 300, and the third control signal DCS may be supplied to the data driver 400. Additionally, the timing controller 500 may realign image data IDATA supplied from the outside and supply the image data IDATA as an image data signal RGB to the data driver 400.

A scan start signal and clock signals may be included in the first control signal SCS. The scan start signal may control a first timing of a scan signal. The clock signals may be used to shift the scan start signal.

An emission control start pulse and clock signals may be included in the second control signal ECS. The emission control start pulse may control a first timing of an emission control signal. The clock signals may be used to shift the emission control start pulse.

A source start pulse and clock signals may be included in the third control signal DCS. The source start pulse may control a sampling start time of data. The clock signals may be used to control a sampling operation.

In an exemplary embodiment of the inventive concept, the timing controller 500 may generate a fourth control signal PCS for controlling driving of the power supply 600. The fourth control signal PCS may control a supply timing of at least one of the first power source VDD, the second power source VSS, the initialization power source VINT, the low power source VGL, and the high power source VGH.

The scan driver 200 may receive the first control signal SCS from the timing controller 500, and supply a scan signal to the scan lines S1 to Sn based on the first control signal SCS. For example, the scan driver 200 may sequentially the scan signal to the scan lines S1 to Sn. When the scan signal is sequentially supplied, the pixels P may be selected in units of horizontal lines (or units of pixel rows).

The scan signal may be set to a gate-on voltage (e.g., a low voltage). A transistor that is included in the pixels P and receives the scan signal may be set to a turn-on state when the scan signal is supplied.

The emission driver 300 may receive the second control signal ECS from the timing controller 500, and supply an emission control signal to the emission control lines E1 to En based on the second control signal ECS. For example, the emission driver 300 may sequentially supply the emission control signal to the emission control lines E1 to En.

The emission control signal may be set to a gate-on voltage (e.g., a low voltage). A transistor that is included in the pixel P and receives the emission control signal may be turned on when the emission control signal is supplied, and be set to a turn-off state in other cases.

The emission control signal is used to control emission times of the pixels P. To this end, the emission control signal may be set to have a width wider than that of the scan signal. For example, the scan driver 200 may supply a scan signal to an (i−1)th scan line Si−1 and an ith scan line Si to overlap with a gate-off period of an emission control signal supplied to an ith emission control line Ei (where i is an integer that is no less than 2 and is no more than n).

Each of the scan driver 200 and the emission driver 300 may be mounted on a substrate through a thin film process. In addition, the scan driver 200 may be located at both sides of the pixel unit 100 with the pixel unit 100 interposed therebetween. The emission driver 300 may also be located at both sides of the pixel unit 100 with the pixel unit 100 interposed therebetween.

Although a case where the scan driver 200 and the emission driver 300 respectively supply the scan signal and the emission control signal is illustrated in FIG. 1, the inventive concept is not limited thereto. In an example, the scan signal and the emission control signal may be supplied by a single driver.

The data driver 400 may receive the third control signal DCS and the image data signal RGB from the timing controller 500. The data driver 400 may supply a data signal to the data lines D1 to Dm, corresponding to the third control signal DCS. The data signal supplied to the data lines D1 to Dm may be supplied to pixels P selected by the scan signal. To this end, the data driver 400 may supply the data signal to the data lines D1 to Dm to be synchronized with the scan signal.

Although a case where n scan lines S1 to Sn and n emission control lines E1 to En are provided is illustrated in FIG. 1, the inventive concept is not limited thereto. In an exemplary embodiment of the inventive concept, pixels P located on a current horizontal line (or current pixel row) may be additionally coupled to a scan line located on a previous horizontal line (or previous pixel row) and/or a scan line located on a next horizontal line (or next pixel row), corresponding to a pixel structure of the pixels P. To this end, dummy scan lines and/or dummy emission control lines, may be additionally formed in the pixel unit 100.

Figure 2:
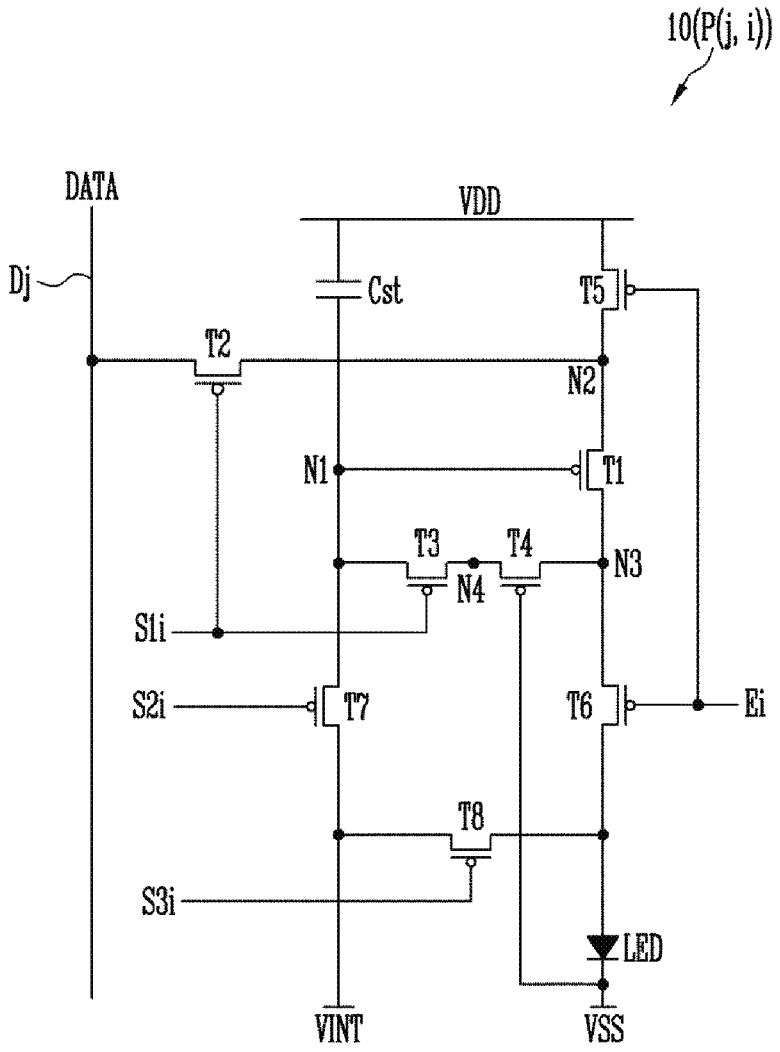
FIG. 2 is a circuit diagram illustrating a pixel included in the display device shown in FIG. 1 in accordance with an exemplary embodiment of the inventive concept.

FIG. 2 is a circuit diagram illustrating a pixel included in the display device shown in FIG. 1 in accordance with an exemplary embodiment of the inventive concept.

For convenience of description, a pixel 10 (or P(j, i)) that is located on an ith horizontal line (or ith pixel row) and is coupled to a jth data line Dj is illustrated in FIG. 2 (where i and j are natural numbers).

Referring to FIG. 2, the pixel 10 may include the light emitting device LED, first to eighth transistors T1 to T8, and a storage capacitor Cst.

A first electrode of the light emitting device LED may be coupled to one electrode of the eighth transistor T8, and a second electrode of the light emitting device LED may be coupled to the second power source VSS. The light emitting device LED may generate light with a predetermined luminance corresponding to an amount of current (driving current) supplied from the first transistor T1. In an exemplary embodiment of the inventive concept, the light emitting device LED may be an organic light emitting diode including an organic emitting layer. The first electrode of the light emitting device LED may be an anode electrode, and the second electrode of the light emitting device LED may be a cathode electrode. On the contrary, the first electrode of the light emitting device LED may be the cathode electrode, and the second electrode of the light emitting device LED may be the anode electrode.

In an exemplary embodiment of the inventive concept, the light emitting device LED may be an inorganic light emitting device including an inorganic material. Alternatively, the light emitting device LED may have a form in which a plurality of inorganic light emitting devices are coupled in parallel and/or series between the second power source VSS and one electrode of the eighth transistor T8.

The first transistor T1 may be coupled between a second node N2 electrically coupled to the first power source VDD and a third node N3 electrically coupled to the first electrode of the light emitting device LED. The first transistor T1 may generate a driving current and provide the driving current to the light emitting device LED. A gate electrode of the first transistor T1 may be coupled to a first node N1. The first transistor T1 serves as a driving transistor of the pixel 10.

The second transistor T2 may be coupled between a data line (e.g., a jth data line Dj) and the second node N2. The second transistor T2 may include a gate electrode receiving a scan signal. For example, the gate electrode of the second transistor T2 may be coupled to a first scan line S1*i* of the ith pixel row. The second transistor T2 may be turned on when a scan signal is supplied to the first scan line S1*i*, to electrically couple the jth data line Dj and the second node N2 to each other. Therefore, a data voltage DATA (or data signal) may be transferred to the second node N2.

The storage capacitor Cst is coupled between the first power source VDD and the first node N1. The storage capacitor Cst may store the data voltage DATA (and a voltage corresponding to a threshold voltage of the first transistor T1).

The fifth transistor T5 may be coupled between the first power source VDD and the second node N2. The fifth transistor T5 may include a gate electrode receiving an emission control signal. The gate electrode of the fifth transistor T5 may be coupled to an emission control line Ei.

The sixth transistor T6 may be coupled between the third node N3 and the first electrode of the light emitting device LED. The sixth transistor T6 may include a gate electrode receiving the emission control signal. The gate electrode of the sixth transistor T6 may be coupled to the emission control line Ei.

The fifth and sixth transistors T5 and T6 may be turned on in a gate-on period (e.g., a logic low level period) of the emission control signal, and be turned off in a gate-off period (e.g., a logic high level period) of the emission control signal.

The seventh transistor T7 may be coupled between the first node N1 and the initialization power source VINT. The seventh transistor T7 may include a gate electrode coupled to a second scan line S2*i* of the ith pixel row.

The seventh transistor T7 may be turned on when a scan signal is supplied to the second scan line S2*i*, to supply a voltage of the initialization power source VINT to the first node N1. Accordingly, a voltage of the first node N1, e.g., a gate voltage of the first transistor T1 can be initialized to the voltage of the initialization power source VINT. In an exemplary embodiment of the inventive concept, the initialization power source VINT may be set to a voltage lower than the lowest voltage of the data voltage DATA.

The eighth transistor T8 may be coupled between the initialization power source VINT and the first electrode of the light emitting device LED. The eighth transistor T8 may include a gate electrode coupled to a third scan line S3*i* of the ith pixel row.

The eighth transistor T8 may be turned on when a scan signal is supplied to the third scan line S3*i*, to supply the voltage of the initialization power source VINT to the first electrode of the light emitting device LED. When the voltage of the initialization power source VINT is supplied to the first electrode of the light emitting device LED, a parasitic capacitor of the light emitting device LED may be discharged. When the parasitic capacitor is discharged, a black expression ability of the pixel 10 can be improved.

The third transistor T3 may be electrically coupled between the first node N1 and the third node N3. The third transistor T3 may include a gate electrode coupled to the first scan line S1*i*. Specifically, the third transistor T3 may be directly coupled between the first node N1 and a fourth node N4.

The third transistor T3 may be turned on when a scan signal is supplied to the first scan line S1*i*, to electrically couple the gate electrode of the first transistor T1 and the third node N3 to each other. Therefore, the first transistor T1 may be diode-coupled when the third transistor T3 is turned on. In other words, the third transistor T3 may function to write the data voltage DATA for the first transistor T1 and to compensate for the threshold voltage of the first transistor T1.

In the case of the pixel 10 configured with P-channel Metal Oxide Semiconductor (PMOS) transistors, a black data voltage is set greater than a white data voltage. In an example, the black data voltage may be set to about 6.6 V, and the white data voltage may be set to about 3 V. The black data voltage is the data voltage DATA corresponding to a black image, and the white data voltage is the data voltage DATA corresponding to a white image.

Therefore, a degradation speed between pixels supplied with the black data voltage and the white data voltage may vary, and accordingly, image sticking may occur.

Such degradation difference and image sticking are considerably influenced by a difference between a gate-source voltage (e.g., Vgs) of the third transistor T3 when the black data voltage is applied and the gate-source voltage of the third transistor T3 when the white data voltage is applied. For example, when the black data voltage is applied, the difference between the gate-source voltage of the third transistor T3 in an on-bias state (or turn-on state) and the gate-source voltage of the third transistor T3 in an off-bias state (or turn-off state) may be calculated as a first delta. When the white data voltage is applied, the deviation between the gate-source voltage of the third transistor T3 in the on-bias state and the gate-source voltage of the third transistor T3 in the off-bias state may be calculated as a second delta.

The third transistor T3 is degraded due to fluctuation in the gate-source voltage of the third transistor T3. In addition, pixels have different degradation levels due to the difference between the first delta and the second delta. Therefore, the display device is susceptible to image sticking when the difference between the first delta and the second delta increases.

Each of the first delta and the second delta may be adjusted by decreasing the difference between the gate-source voltages of the third transistor T3, which respectively correspond to the white data voltage and the black data voltage. For example, in the on-bias state, when the difference between the gate-source voltage of the third transistor T3 when the black data voltage is applied and the gate-source voltage of the third transistor T3 when the white data voltage is applied is decreased, the degradation difference (or deviation) can be minimized.

To minimize degradation deviation and image sticking, the fourth transistor T4 may be coupled between the third transistor T3 (or the fourth node N4) and the third node N3. In other words, the fourth transistor T4 may be coupled in series to the third transistor T3 between the first node N1 and the third node N3.

The fourth transistor T4 may always maintain the turn-on state. A gate electrode of the fourth transistor T4 may be coupled to a DC power source having a voltage level at which the fourth transistor T4 is turned on. In an exemplary embodiment of the inventive concept, the gate electrode of the fourth transistor T4 may be coupled to the second power source VSS. The second power source VSS may have a negative voltage level at which the fourth transistor T4 can be turned on. For example, the second power source VSS may be set to about −4.5 V.

The fourth transistor T4 may always maintain the turn-on state, and serve as a predetermined resistor. Therefore, a voltage of a first electrode of the third transistor T3, e.g., a voltage of the fourth node N4, may be dropped. Accordingly, a source voltage of the third transistor T3 may be dropped, and an absolute value of the gate-source voltage of the third transistor T3 in the on-bias state may be decreased. In particular, in the on-bias state, the absolute value (e.g., |Vgs|) of the gate-source voltage of the third transistor T3 when the black data voltage is applied may be relatively considerably decreased by the fourth transistor T4 that serves as the resistor. Although the fourth transistor T4 is added to the pixel 10, the gate-source voltage of the third transistor T3 in the off-bias state is not changed.

Consequently, in the on-bias state, the deviation between the gate-source voltage of the third transistor T3 when the black data voltage is applied and the gate-source voltage of the third transistor T3 when the white data voltage is applied can be decreased. In addition, the fluctuation width of the gate-source voltage when the third transistor T3 is repeatedly turned on/off is decreased, so that stress (degradation) applied to the third transistor T3 can be reduced. Accordingly, a degradation level of the third transistor T3 when the black data voltage is applied and a degradation level of the third transistor T3 when the white data voltage is applied can be similar to each other. Thus, image sticking can be minimized or prevented.

Figure 4:
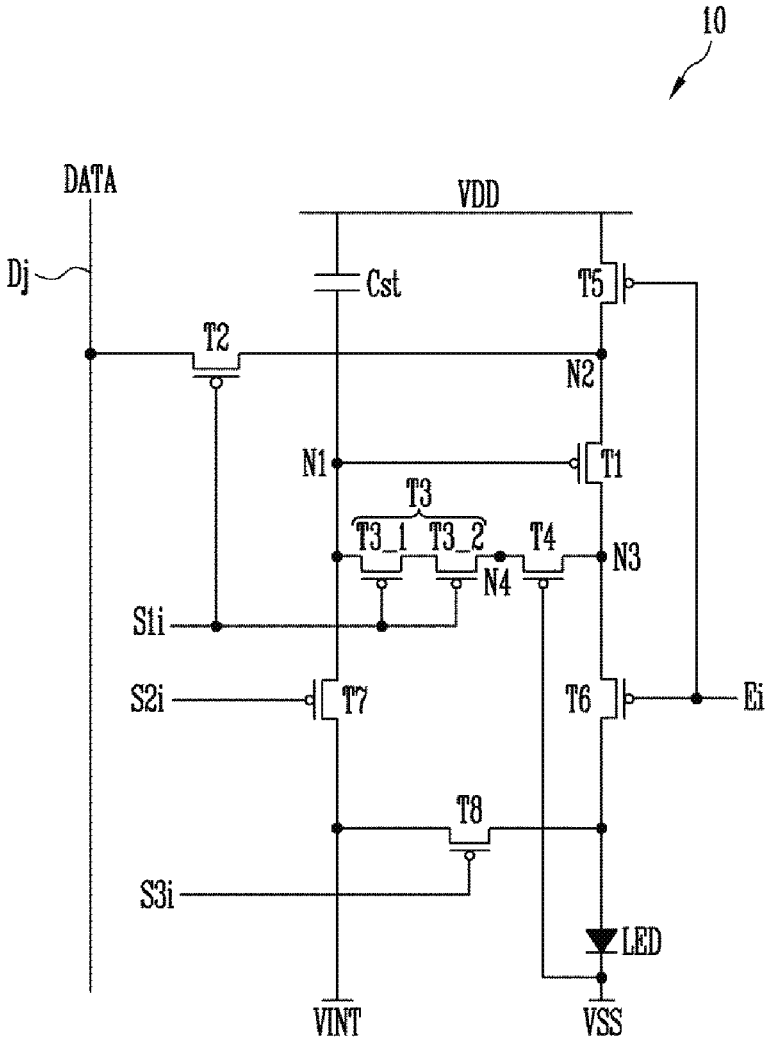
FIG. 4 is a circuit diagram illustrating a pixel included in the display device shown in FIG. 1 in accordance with an exemplary embodiment of the inventive concept.

The absolute value (e.g., |Vsd|) of a source-drain voltage of the third transistor T3 is decreased by the fourth transistor T4 that serves as the resistor, so that current leakage through the third transistor T3 (particularly, current leakage caused by a serial coupling structure of third transistors in FIG. 4), and a bright spot and/or a dark spot of an image due to the current leakage can be prevented or reduced.

Although the transistors T1 to T8 included in the pixel 10 are implemented with P-type transistors in FIG. 2, the type of the transistors is not limited thereto. For example, at least some of the transistors T1 to T8 may be implemented with N-type transistors.

Figure 3A:
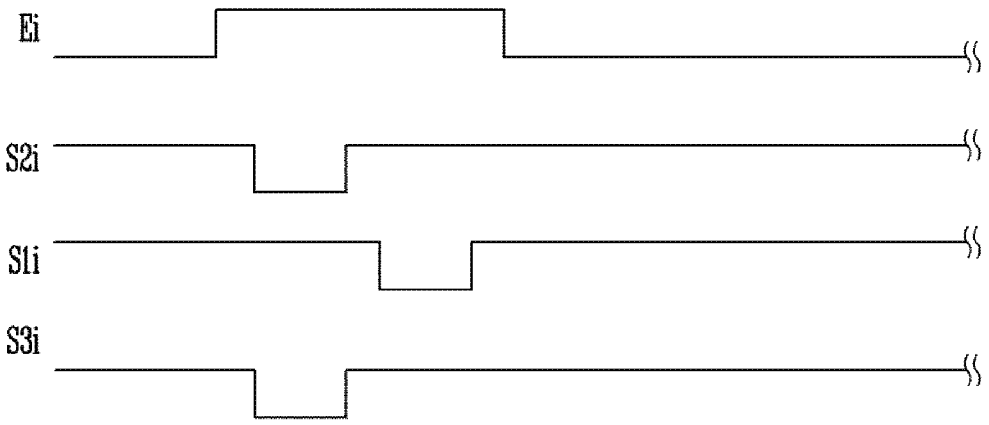
FIGS. 3A and 3B are timing diagrams illustrating an operation of the pixel shown in FIG. 2 in accordance with exemplary embodiments of the inventive concept.
Figure 3B:
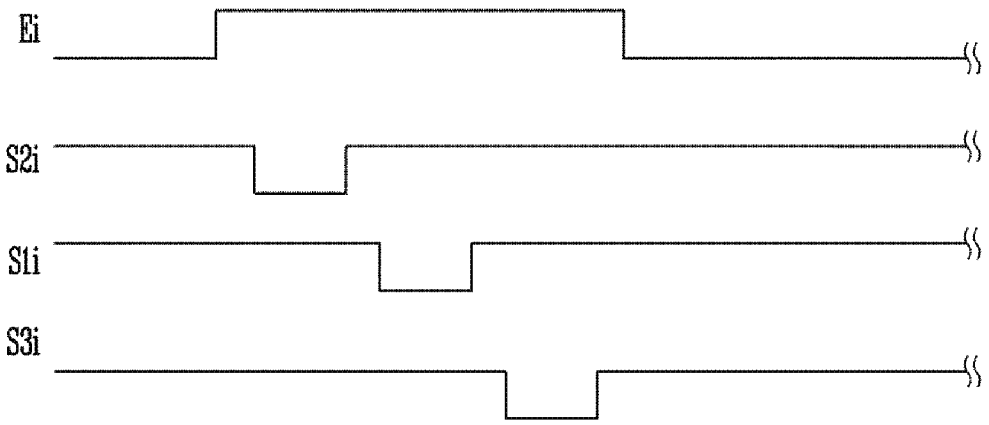

FIGS. 3A and 3B are timing diagrams illustrating an operation of the pixel shown in FIG. 2 according to exemplary embodiments of the inventive concept.

Referring to FIGS. 2 to 3B, a scan signal (low voltage) may be supplied to the first to third scan lines S1*i*, S2*i*, and S3*i* in a period in which an emission control signal supplied to the emission control line Ei has a gate-off voltage (high voltage).

When the fifth and sixth transistors T5 and T6 are turned off by the emission control signal, electrical coupling between the first power source VDD and the second node N2 is interrupted. Therefore, the pixel 10 may be set to a non-emission state during the period in which the emission control signal has the gate-off voltage.

Subsequently, a scan signal may be supplied to the second scan line S2*i*. For example, the second scan line S2*i* may be substantially the same as a first scan line (e.g., S1*i*−1) of a previous pixel row (e.g., an (i−1)th pixel row). Alternatively, a scan signal may be substantially simultaneously supplied to the second scan line S2*i* and the first scan line (e.g., S1*i*−1) of the previous pixel row. When a scan signal is supplied to the second scan line S2*i*, the seventh transistor T7 may be turned on, and the voltage of the initialization power source VINT may be supplied to the first node N1.

In an exemplary embodiment of the inventive concept, as shown in FIG. 3A, a scan signal may be substantially simultaneously supplied to the third scan line S3*i* and the second scan line S2*i*. For example, the third scan line S3*i* and the second scan line S2*i* may be the same scan line. When a scan signal is supplied to the third scan line S3*i*, the eighth transistor T8 may be turned on. When the eighth transistor T8 is turned on, the voltage of the initialization power source VINT may be supplied to the first electrode of the light emitting device LED.

Subsequently, a scan signal may be supplied to the first scan line S1*i*, and the second and third transistors T2 and T3 may be turned on. When the second transistor T2 is turned on, the data voltage DATA may be supplied to the second node N2. When the third transistor T3 is turned on, the first transistor T1 may be diode-coupled. The fourth transistor T4 may always maintain the turn-on state, and the voltage of the fourth node N4 may be different from that of the third node N3. For example, the voltage of the fourth node N4 may be smaller than that of the third node N3.

When the first transistor T1 is turned on, the data voltage DATA supplied to the second node N2 may be supplied to the first node N1 via the diode-coupled first transistor T1. The storage capacitor Cst may store a voltage applied to the first node N1.

After the voltage of the first node N1 is stored in the storage capacitor Cst, the emission control signal may be supplied to the emission control line Ei. When the emission control signal is supplied to the emission control line Ei, the fifth and sixth transistors T5 and T6 may be turned on.

The first transistor T1 may control an amount of driving current flowing from the first power source VDD to the second power source VSS via the light emitting device LED, corresponding to the voltage of the first node N1.

In an exemplary embodiment of the inventive concept, as shown in FIG. 3B, a scan signal may be supplied to the third scan line S3*i* after a scan signal is supplied to the first scan line Si1. The third scan line S3*i* may be substantially the same as a first scan line (e.g., S1*i*+1) of a next pixel row (e.g., an (i+1)th pixel row). However, this is merely illustrative, and the third scan line S3*i* may be replaced with the first scan line S1*i* of the ith pixel row.

FIG. 4 is a circuit diagram illustrating a pixel included in the display device shown in FIG. 1 according to an exemplary embodiment of the inventive concept.

In FIG. 4, components identical to those described with reference to FIG. 2 are designated by like reference numerals, and their overlapping descriptions will be omitted. In addition, the pixel shown in FIG. 4 may have a configuration identical or similar to that of the pixel shown in FIG. 2, except a third transistor.

Referring to FIG. 4, the third transistor T3 included in the pixel 10 may include a plurality of third transistors T3_1 and T3_2 coupled in series to each other.

The third transistors T3_1 and T3_2 may be coupled in series between the first node N1 and the fourth transistor T4 (or the fourth node N4). Gate electrodes of the third transistors T3_1 and T3_2 may be commonly coupled to the first scan line S1*i*.

When the third transistors T3_1 and T3_2 are coupled in series, a leakage current flowing through the third transistors T3_1 and T3_2 in the turn-off state can be prevented. However, the third transistors T3_1 and T3_2 do not completely have the same device characteristics due to process limitations. Therefore, when a scan signal is supplied to the first scan line S1*i*, the third transistors T3_1 and T3_2 may be turned on at different times. In other words, the source-drain voltage of the third transistor T3 is asymmetrically divided and applied to the third transistors T3_1 and T3_2, and therefore, unintended current leakage may occur.

Accordingly, the fourth transistor T4 that always maintains the turn-on state may be coupled between the fourth node N4 and the third node N3. The fourth transistor T4 serves as a resistor, so that the degradation level of the third transistor T3 for each pixel 10 according to the magnitude of a data voltage can be equalized. Thus, image sticking can be minimized.

Figure 5:
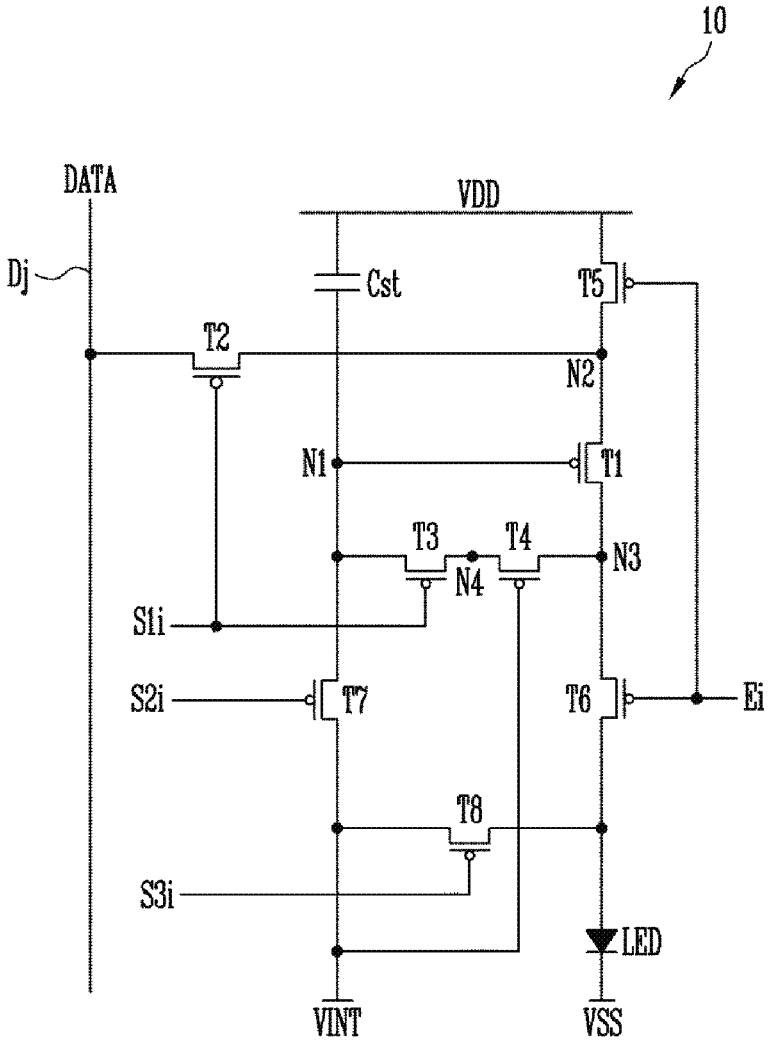
FIGS. 5 and 6 are circuit diagrams illustrating a pixel included in the display device shown in FIG. 1 in accordance with exemplary embodiments of the inventive concept.
Figure 6:
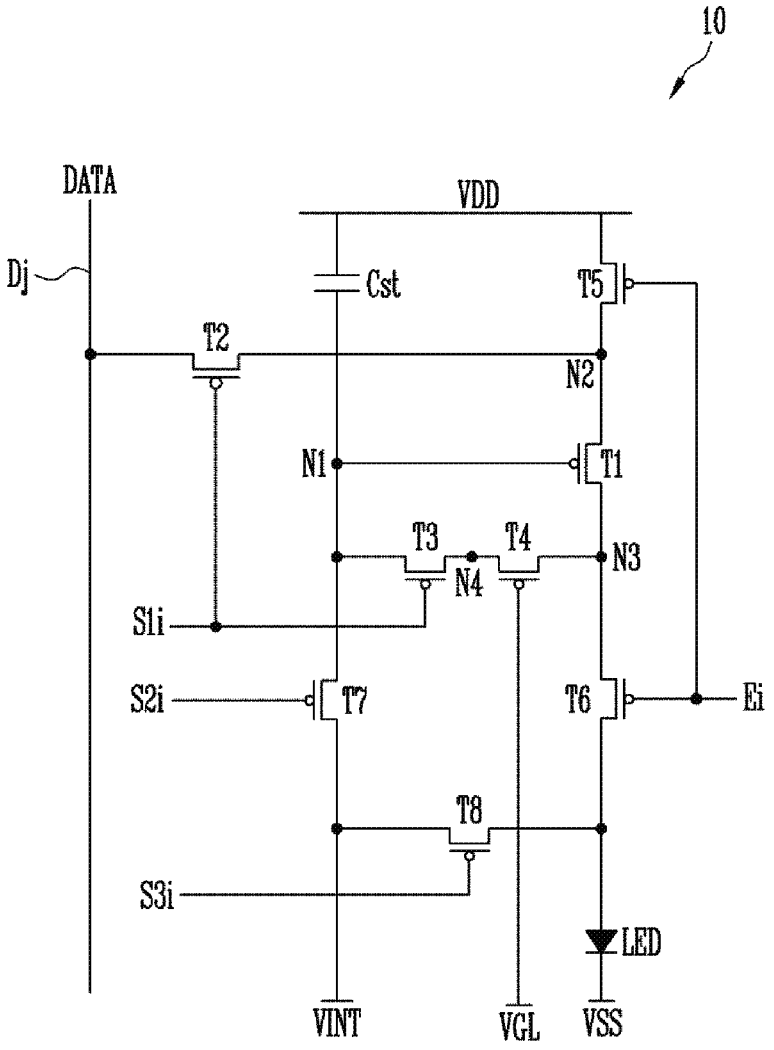

FIGS. 5 and 6 are circuit diagrams illustrating a pixel included in the display device shown in FIG. 1 according to exemplary embodiments of the inventive concept.

In FIGS. 5 and 6, components identical to those described with reference to FIG. 2 are designated by like reference numerals, and their overlapping descriptions will be omitted. In addition, each of the pixels shown in FIGS. 5 and 6 may have a configuration identical or similar to that of the pixel shown in FIG. 2, except a fourth transistor.

Referring to FIGS. 5 and 6, the fourth transistor T4 included in the pixel 10 may be coupled between the third node N3 and the fourth node N4.

The fourth transistor T4 may always maintain the turn-on state. In an exemplary embodiment of the inventive concept, as shown in FIG. 5, a gate electrode of the fourth transistor T4 may be coupled to the initialization power source VINT. In an exemplary embodiment of the inventive concept, as shown in FIG. 6, a gate electrode of the fourth transistor T4 may be coupled to the low power source VGL. The low power source VGL may be a DC power source supplied to the scan driver (e.g., 200 shown in FIG. 1) so as to generate a scan signal.

In an exemplary embodiment of the inventive concept, the initialization power source VINT and the low power source VGL may have a voltage level lower than that of the second power source VSS. For example, the initialization power source VINT may be set to about −5 V to about −10 V, and the low power source VGL may be set to about −8 V to about −10 V. Thus, the fourth transistor T4 can more stably maintain the turn-on state.

As described above, in the pixel 10 and the display device (e.g., 1000 shown in FIG. 1) in accordance with an exemplary embodiment of the inventive concept, the pixel 10 includes the fourth transistor T4 coupled in series to the third transistor T3, so that degradation levels of the third transistors T3 in the pixels 10 according to differences between data voltages can become similar. Thus, image sticking can be minimized or prevented.

Further, the source-drain voltage of the third transistor T3 is decreased by the fourth transistor T4, so that current leakage (particularly, current leakage caused by a serial coupling structure of the third transistors shown in FIG. 4) into the storage capacitor Cst through the third transistor T3, and a bright spot and/or a dark spot of an image due to the current leakage can be prevented or reduced.

In some instances, as would be apparent to one of ordinary skill in the art as of the filing of the present application, features, characteristics, and/or elements described in connection with a particular exemplary embodiment may be used singly or in combination with features, characteristics, and/or elements described in connection with other exemplary embodiments unless otherwise specifically indicated.

While the inventive concept has been shown and described with reference to exemplary embodiments thereof, it will be understood by those of ordinary skill in the art that various changes in form and details may be made thereto without departing from the spirit and scope of the inventive concept as set forth in the following claims.

What is claimed is:

1. A pixel comprising:

a light emitting device;

a first transistor configured to control an amount of current flowing from a first power source to a second power source via the light emitting device, in response to a voltage applied to a first node;

a second transistor coupled between a data line and a second node corresponding to a first electrode of the first transistor, and comprising a gate electrode coupled to a first scan line;

a third transistor coupled between the first node and a third node corresponding to a second electrode of the first transistor, and comprising a gate electrode coupled to the first scan line;

a fourth transistor coupled between the third transistor and the third node and configured to maintain a turn-on state; and another transistor coupled directly between the light emitting device and an initialization power source, and comprising a gate electrode coupled to another scan line, wherein the fourth transistor comprises a gate electrode coupled to the second power source.

2. The pixel of claim 1, wherein the third and fourth transistors are coupled in series between the first node and the third node.

3. The pixel of claim 1, wherein the third transistor comprises a plurality of third transistors coupled in series to each other between the first node and the fourth transistor, and wherein gate electrodes of the plurality of third transistors are commonly coupled to the first scan line.

4. The pixel of claim 1, further comprising:

a fifth transistor coupled between the first power source and the second node, and comprising a gate electrode coupled to an emission control line;

a sixth transistor coupled between the third node and the light emitting device, and comprising a gate electrode coupled to the emission control line; and a storage capacitor coupled between the first power source and the first node.

5. The pixel of claim 4, further comprising:

a seventh transistor coupled between the first node and the initialization power source, and comprising a gate electrode coupled to a second scan line.

6. The pixel of claim 5, wherein said another scan line and the second scan line are the same scan line.

7. A display device comprising:

pixels coupled to scan lines, emission control lines, and data lines;

a scan driver configured to supply a scan signal to the pixels through the scan lines;

an emission driver configured to supply an emission control signal to the pixels through the emission control lines; and a data driver configured to supply a data signal to the pixels through the data lines, wherein a pixel on an ith row and a jth column (where i and j are natural numbers) among the pixels includes:

a light emitting device;

a first transistor configured to control an amount of current flowing from a first power source to a second power source via the light emitting device, in response to a voltage applied to a first node;

a second transistor coupled between a jth data line and a second node corresponding to a first electrode of the first transistor, and comprising a gate electrode coupled to a first scan line on an ith pixel row;

a third transistor coupled between the first node and a third node corresponding to a second electrode of the first transistor, and comprising a gate electrode coupled to the first scan line on the ith pixel row; and a fourth transistor coupled between the third transistor and the third node, and comprising a gate electrode directly coupled to an initialization power source configured to maintain a turn-on state.

8. The display device of claim 7, wherein the third and fourth transistors are coupled in series between the first node and the third node.

9. The display device of claim 7, wherein the fourth transistor comprises a gate electrode coupled to a DC power source which allows the fourth transistor to be turned on.

10. The display device of claim 9, wherein the gate electrode of the fourth transistor is coupled to the second power source.

11. The display device of claim 7, wherein the third transistor comprises a plurality of third transistors coupled in series to each other between the first node and the fourth transistor, and wherein gate electrodes of the plurality of third transistors are commonly coupled to the first scan line on the ith pixel row.

12. The display device of claim 7, wherein the pixel on the ith row and the jth column further comprises:

a fifth transistor coupled between the first power source and the second node, and comprising a gate electrode coupled to an emission control line;

a sixth transistor coupled between the third node and the light emitting device, and comprising a gate electrode coupled to the emission control line; and a storage capacitor coupled between the first power source and the first node.

13. The display device of claim 12, wherein the pixel on the ith row and the jth column further comprises:

a seventh transistor coupled between the first node and the initialization power source, and comprising a gate electrode coupled to a second scan line on the ith pixel row; and an eighth transistor coupled between the light emitting device and the initialization power source, and comprising a gate electrode coupled to a third scan line on the ith pixel row.

14. The display device of claim 13, further comprising:

a power supply configured to generate the first power source and the second power source to supply the first power source and the second power source to the pixels, and generate third and fourth power sources to supply the third and fourth power sources to the scan driver for generating the scan signal.

15. The display device of claim 14, wherein the fourth transistor comprises a gate electrode coupled to the third power source.

16. A pixel comprising:

a light emitting device;

a first transistor configured to control an amount of current flowing from a first power source to a second power source via the light emitting device, in response to a voltage applied to a first node;

a second transistor coupled between a data line and a second node corresponding to a first electrode of the first transistor, and comprising a gate electrode coupled to a scan line;

a plurality of third transistors coupled in series between the first node and a fourth node, and comprising gate electrodes coupled to the scan line; and a fourth transistor coupled between the fourth node and a third node corresponding to a second electrode of the first transistor, and comprising a gate electrode coupled to the second power source, the gate electrode of the fourth transistor receiving a voltage of the second power source.

17. The pixel of claim 16, further comprising another transistor coupled between the light emitting device and an initialization power source, and comprising a gate electrode coupled to another scan line.

* * * * *